US005184859A

United States Patent [19]

Nihra et al.

[11] Patent Number: 5,184,859

[45] Date of Patent: Feb. 9, 1993

[54] GOLF BALL RETRIEVER

[76] Inventors: Thomas E. Nihra; Joseph A. Nihra, both of Hazel Park, Mich.

[21] Appl. No.: 871,003

[22] Filed: Apr. 20, 1992

Related U.S. Application Data

[63] Continuation-in-part of Ser. No. 792,666, Nov. 15, 1991, abandoned.

[51] Int. Cl.[5] ..... A63B 47/02

[52] U.S. Cl. ..... 294/19.2; 294/104

[58] Field of Search ..... 294/19.1, 19.2, 104; 273/32 A, 32 B, 32 F, 32 D, 162 E, 162 D; 403/361

[56] References Cited

U.S. PATENT DOCUMENTS

| | | | |
|---|---|---|---|
| 3,046,044 | 7/1962 | Christle | 294/19.2 |
| 3,273,927 | 9/1966 | Carlson | 294/19.2 |
| 3,547,477 | 12/1970 | Young | 294/19.2 |
| 4,013,295 | 3/1977 | Baughman | 273/162 E |
| 4,046,413 | 9/1977 | Jeninga | 294/19.2 |
| 4,746,156 | 5/1988 | Kremer | 294/19.2 |
| 4,953,906 | 9/1990 | White | 294/19.2 |

*Primary Examiner*—Charles A. Marmor

*Assistant Examiner*—Dean J. Kramer

*Attorney, Agent, or Firm*—John P. Moran

[57] ABSTRACT

A golf ball retriever comprising a molded body having two outer and a middle opening formed in one end thereof. The middle opening has oppositely disposed tapered sides formed thereon. A molded flipper is pivotally mounted in the middle opening between the tapered sides. A molded partial ring-like member having two legs formed thereon is mounted in the two outer openings. A spherical pocket is formed in the inner surface of the ring-like member opposite the two legs. A single pin is mounted through aligned openings formed in the molded body, the legs and the molded flipper. An extension is formed on the other end of said molded body, with a cylindrical groove formed therein. A solid stem extends from the extension through the cylindrical groove and beyond the end of the extension. A tubular section is secured on the solid stem in the said cylindrical groove. In an alternate embodiment the two legs of the partial ring-like member are integrally molded on the end of the body in lieu of the two outer openings for receiving same, and protrusions formed adjacent the end of the flipper replace the single pin.

12 Claims, 2 Drawing Sheets

GOLF BALL RETRIEVER

This application is a continuation-in-part application of Ser. No. 07/792,666 filed Nov. 15, 1991, now abandoned.

TECHNICAL FIELD

This invention relates generally to ball retriever devices and, more particularly, to golf ball retrievers.

BACKGROUND ART

It is desirable on the part of most golfers today to carry a golf ball retriever in their golf bags. The retriever should be lightweight, telescopically expandable to a substantial length, say, eighteen feet, and capable of gripping a golf ball with a light touch from either side thereof.

Numerous varieties of golf ball retrievers have been known heretofore. One such known golf ball retriever is disclosed in Jenings U.S. Pat. No. 4,046,413, including a pair of spaced apart wire loops extending from the open end of a ferrule, with a generally U-shaped wire gate pivotally mounted intermediate the loops, and having its ends pivotally mounted in openings formed in oppositely disposed outside walls of the ferrule.

Another known golf ball retriever is shown as "prior art" in the applicants' FIG. 6. This arrangement includes a square cross-sectional metal tubular member into which a metal substantially U-shaped strap has its ends inserted and secured by two spaced pins extended between oppositely disposed walls adjacent the end thereof. A T-shaped wire gate is pivotally mounted at the end of its stem in the center of the tubular member on a third pin extended between the oppositely disposed walls, with the two spaced pins serving as stops for the wire gate.

DISCLOSURE OF THE INVENTION

A general object of the invention is to provide an improved golf ball retriever.

Another object of the invention is to provide a golf ball retriever including a molded block having three four-sided openings formed in one end thereof, one of which has tapered sides for pivotally retaining a square cross-sectioned plastic stem having an arcuate shaped and chamfered wide outer end portion formed thereon, and two of which fixedly retain opposite straight ends formed on a substantially round plastic ball receptacle.

A further object of the invention is to provide such a golf ball retriever wherein the molded block has an annular groove formed in the other end thereof around a solid round stem extending therefrom for receiving the first one of a set of telescopic tubular extensions, the latter being secured around the round stem by either a rolled groove or by oppositely disposed staked openings.

A still further object of the invention is to provide an alternate embodiment including a molded block having a middle opening formed in one end thereof for pivotally retaining a rectangular cross-sectioned plastic stem having an arcuate shaped and chamfered wide outer end portion formed thereon, and a partial ring-like member having two legs formed thereon and integrally molded on the one end of the molded block on opposite sides of the middle opening such that the partial ring-like member extends past the wide outer end portion.

These and other object and advantages of the invention will become more apparent when reference is made to the following drawings and the accompanying description.

BEST MODE OF CARRYING OUT THE INVENTION

Figure 1:
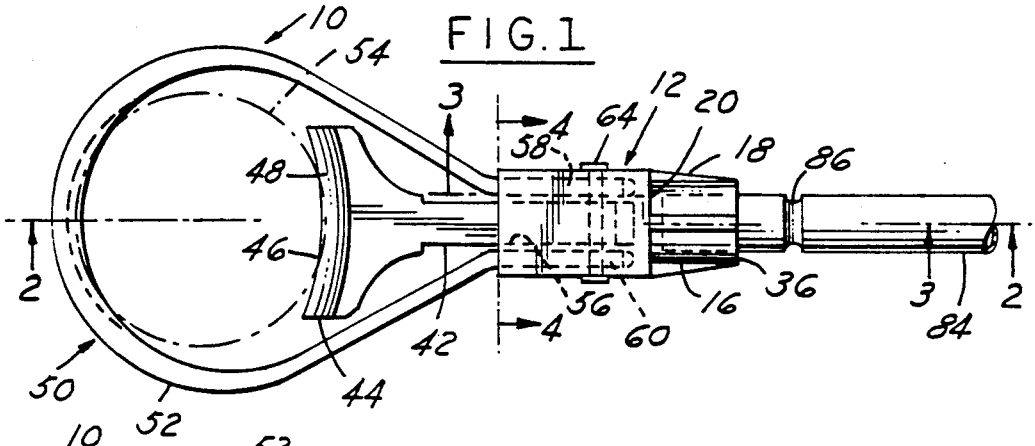
FIG. 1 is a plan view of a golf ball retriever embodying the invention.

Referring now to the drawings in greater detail, FIGS. 1–4 illustrate a golf ball retriever 10 including a molded block 12 having a rectangular-shaped body 14 of a predetermined length and a cylindrical extension 16 of a second predetermined length formed on one end of the body 14. Either two oppositely disposed or four equally spaced triangular support brackets 18 or the like, may be formed on the outer surface of the cylindrical extension 16 and integral with a face 20 of the adjacent body 14.

Two rectangular cross-sectioned openings 22 and 24 (FIGS. 3 and 4) are formed adjacent opposite sides of the body 14 in the end 26 thereof opposite the face 20 to a predetermined depth. A four-sided third opening 28 (FIGS. 2 and 4) is formed in the end 26 intermediate the two openings 22 and 24. The opening 28 has two straight sides 30 adjacent the respective openings 22 and 24 and two tapered sides 32 (FIG. 2) adjacent the other opposite sides of the body 14.

A cylindrical groove 34 is formed in the end 36 of the cylindrical extension 16, around a solid stem 38 extending beyond the end 36.

A generally T-shaped plastic flipper element 40 includes a square cross-sectioned stem 42 having a wide end 44 formed thereon. An arcuate-shaped distal edge 46 is formed on the wide end 44, and oppositely disposed chamfered surfaces 48 are formed adjacent the edge 46.

Figure 2:
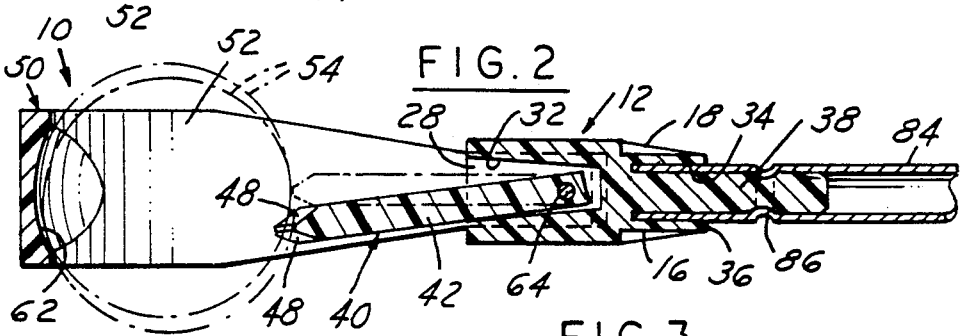
FIGS. 2–4 are cross-sectional views taken along the planes of the respective lines 2—2, 3—3 and 4—4 of FIG. 1 and looking in the directions of the respective arrows.
Figure 4:
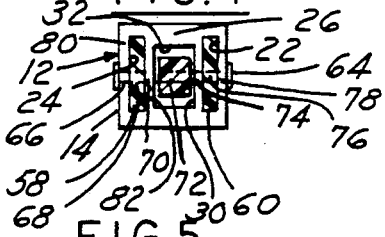
Figure 3:
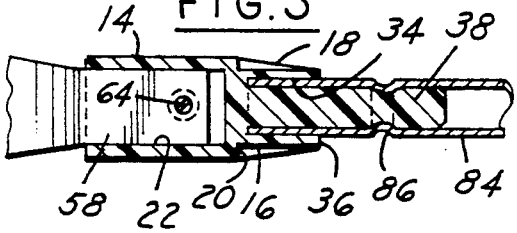

A plastic partial ring-like member 50 includes a wall 52 having an inner diameter larger than the diameter of a golf ball 54, as indicated in FIGS. 1 and 2. The ring-like member 50 also includes an open end 56 formed by spaced extended parallel legs 58 and 60. A spherical pocket 62 is formed in the inner surface of the member 50 opposite the open end 56.

The legs 58 and 60 are fixedly mounted in the openings 22 and 24, and the stem 42 is pivotally mounted in the opening 28. A rivet-like pin 64 is mounted through aligned openings 66, 68, 70, 72, 74, 76, and 78 formed in one outer wall of the body 14, the leg 58, a first inner wall 80 of the body 14, the stem 42, a second inner wall 82 of the body 14, the leg 60, and the other outer wall of the body 14. As such, the legs 58 and 60 are fixedly secured, and the stem 42 is pivotally mounted between the two tapered sides 32 of the opening 28 for a purpose to be described.

Figure 5:
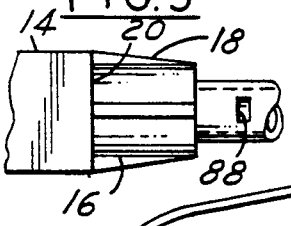
FIG. 5 is a fragmentary view of an alternate embodiment of a portion of the FIG. 1 structure.
Figure 6:
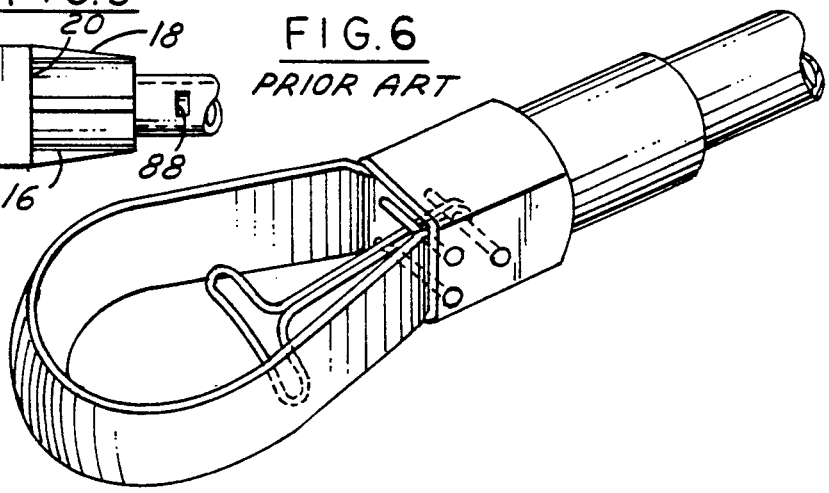
FIG. 6 PRIOR ART
FIG. 6 is a perspective view of a prior art golf ball retriever for which no patent is known to exist.
Figure 7:
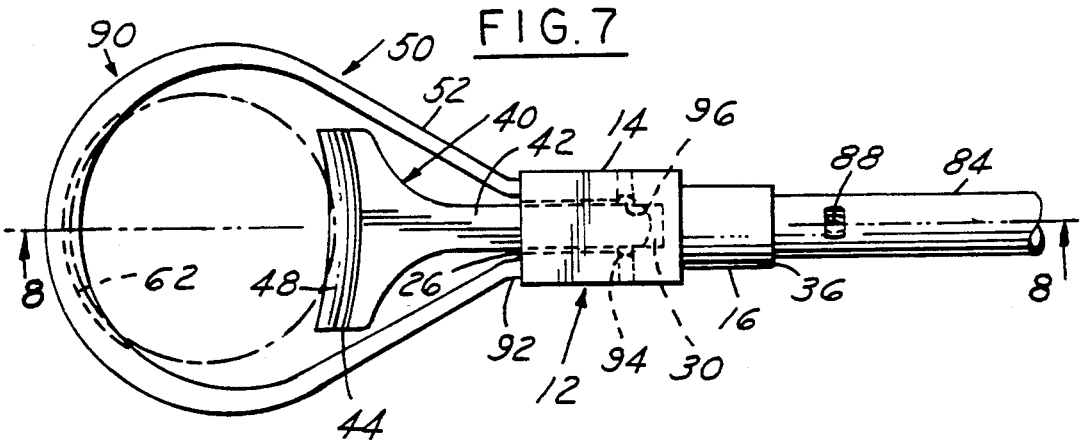
FIG. 7 is a plan view of a golf ball retriever representing a second embodiment of the invention.
Figure 8:
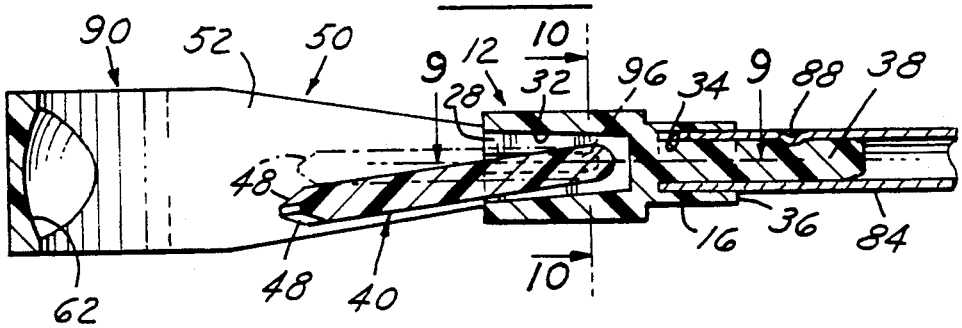
FIGS. 8–10 are cross-sectional views taken along the planes of the respective lines 8—8, 9—9, and 10—10 of FIGS. 7 and 8.
Figure 10:
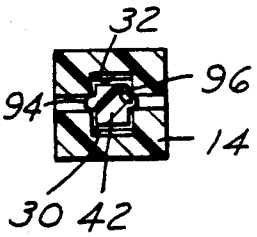
Figure 9:
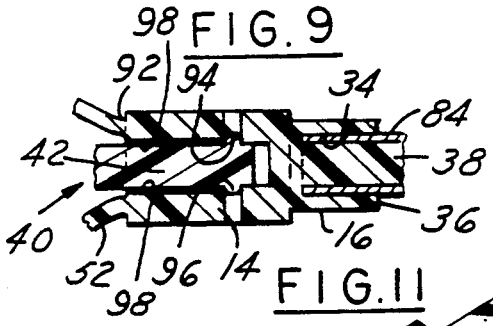
Figure 11:
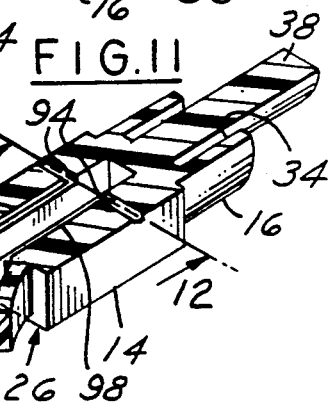
FIG. 11 is a cut-away perspective view of a portion of the golf ball retriever shown in FIG. 7.
Figure 12:
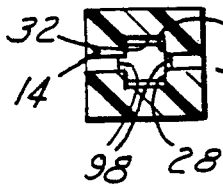
FIG. 12 is a cross-sectional view taken along the plane of line 12—12 of FIG. 11.

A first tubular section 84 of a set of telescopic tubular sections (not shown) has one end thereof mounted in the cylindrical groove 34 around the solid stem 38. An annular groove 86 is formed in the tubular extension 84 adjacent the solid stem 38 such that the inner surface of the annular groove becomes embedded in the surface of the solid stem, to thereby retain the tubular section in the cylindrical groove 34. Alternately, oppositely disposed staked holes 88 (FIG. 5) may be formed through the wall of the tubular extension 84 and into the solid stem 38, in lieu of the annular groove 86.

The brackets 18 serve to support the cylindrical extension 16 and prevent same from breaking off from the block 12 upon any impacts encountered in the use of the retriever 10.

In operation, the member 50 is placed over a golf ball 54 against one of the arcuate shaped chamfered surfaces 48 of the wide end 44 of the flipper element 40. The golf ball 54 then lifts the wide end 44 and concurrently moves laterally into the spherical pocket 62. This allows the wide end 44 to drop down past the center of the golf ball and, when the retriever 10 is lifted, the ball seats on the other arcuate shaped chamfered surface 48 and the edge of the member 50 below the spherical pocket 62, to be returned to the user of the retriever.

In the alternate golf ball retriever 90 embodiment of FIGS. 7–12, it is shown that ends 92 of the wall 52 of the ring-like member are integrally molded on the face of the end 26 of the body 14 on opposite sides of the two straight sides 30 of the opening 28.

A pair of oppositely disposed aligned openings 94 are formed in the two sides 30 adjacent the bottom thereof. Oppositely disposed longitudinal slots 98 (FIGS. 9 and 11) are formed in the walls forming the central opening 28. A pair of projections 96 are formed on opposite sides of the stem 42 adjacent the end thereof and, once the stem has been pushed into the opening 28, guided through the slots 98, the projections 96 are adapted to snap into the openings 94 to provide the pivotal action of the flipper element 40.

In operation, the retriever 90 of FIGS. 7–12 operates the same as described above for the retriever 10 of FIGS. 1–6.

It should be apparent that the golf ball retriever can be used from either side with equally good results.

It should be further apparent that the retriever is a rugged, efficient, and easily handled apparatus.

While but one general embodiment and two alternate fastening means therefor have been shown and described, other modifications are possible within the scope of the following claims.

What is claimed is:

1. A golf ball retriever comprising a molded body having two outer and a middle opening formed in one end thereof, the middle opening having oppositely disposed tapered sides formed thereon, a molded flipper pivotally mounted in said middle opening between said tapered sides, a molded partial ring-like member having two legs formed thereon and mounted in said two outer openings and a spherical pocket formed in the inner surface thereof opposite said two legs, and a single pin mounted through aligned openings formed in said molded body, said legs and said molded flipper.

2. The golf ball retriever described in claim 1, and an extension formed on the other end of said molded body, a cylindrical groove formed therein, a solid stem extending from said extension through said cylindrical groove and beyond the end of said extension, and a tubular section secured on said solid stem in said cylindrical groove.

3. The golf ball retriever described in claim 1, wherein said flipper includes a stem mounted in said middle opening and pivotally retained at the inner end thereof by said single pin, and a wide end formed on the outer end of said stem including an arcuate shaped outer edge having chamfered surfaces formed on opposite sides of said edge.

4. The golf ball retriever described in claim 3, wherein the distance between said arcuate shaped edge when said stem is centrally oriented and the back of said spherical pocket provides minimal clearance past the diameter of a golf ball.

5. The golf ball retriever described in claim 2, wherein said tubular section is secured on said solid stem by an annular groove formed therearound to embed said annular groove into said solid stem.

6. The golf ball retriever described in claim 2, wherein said tubular section is secured on said solid stem by oppositely disposed staked holes formed through said tubular section into said solid stem.

7. The golf ball retriever described in claim 2, wherein said extension is cylindrical in shape, and at least two oppositely disposed brackets are formed on said cylindrical extension and on the adjacent end of said molded body.

8. A golf ball retriever comprising a molded body having a middle opening formed in one end thereof, said middle opening having oppositely disposed tapered sides and oppositely disposed parallel sides formed thereon, and oppositely disposed openings formed in said body adjacent the bottom of said middle opening, a molded flipper having one end thereof pivotally mounted in said middle opening, means for pivotally connecting said one end of said molded flipper to said oppositely disposed openings, a partial ring-like member having two legs formed thereon and secured to said molded body on opposite sides of said middle opening and said flipper, and a spherical pocket formed in the inner surface of said partial ring-like member opposite said two legs.

9. The golf ball retriever described in claim 8, wherein said two legs are integrally molded on said molded body.

10. The golf ball retriever described in claim 8, wherein the sides of said middle opening alternately oppositely disposed with respect to said oppositely disposed openings are tapered so as to diverge outwardly from the bottom thereof.

11. The golf ball retriever described in claim 8, and an extension formed on the other end of said molded body, a cylindrical groove formed therein, a solid stem extending from said extension through said cylindrical groove and beyond the end of said extension, and a tubular section secured on said solid stem in said cylindrical groove.

12. The golf ball retriever described in claim 8, wherein said flipper includes a stem mounted in said middle opening and pivotally retained at the inner end thereof by rounded protrusions formed on opposite sides of said stem adjacent the end thereof, and a wide end formed on the outer end of said stem including an arcuate shaped outer edge having chamfered surfaces formed on opposite sides of said edge.

* * * * *